US005100770A

United States Patent [19]

Ashida

[11] Patent Number: 5,100,770

[45] Date of Patent: Mar. 31, 1992

[54] SUPPORT FOR PHOTOGRAPHIC MATERIALS

[75] Inventor: Tetsuya Ashida, Tokyo, Japan

[73] Assignee: Mitsubishi Paper Mills Limited, Tokyo, Japan

[21] Appl. No.: 595,687

[22] Filed: Oct. 5, 1990

Related U.S. Application Data

[63] Continuation of Ser. No. 333,893, Apr. 6, 1989, abandoned.

[30] Foreign Application Priority Data

Apr. 7, 1988 [JP] Japan ..... 63-86831

[51] Int. Cl.[5] ..... G03C 1/86

[52] U.S. Cl. ..... 430/523; 430/524; 430/525; 162/181.4; 162/181.5; 162/181.6; 428/326; 428/328; 428/404; 428/537.5; 106/437

[58] Field of Search ..... 430/220, 271, 275, 276, 430/523, 524, 525, 531; 162/181.4, 181.6, 181.5; 428/326, 328, 404, 537.1, 537.5; 106/436, 437

[56] References Cited

U.S. PATENT DOCUMENTS

| | | | |
|---|---|---|---|
| 3,730,830 | 5/1973 | Driscoll | 430/538 |
| 4,293,625 | 10/1981 | Myers | 430/523 |
| 4,447,524 | 5/1984 | Uno et al. | 430/538 |
| 4,665,013 | 5/1987 | Sack et al. | 430/523 |
| 4,801,509 | 1/1989 | Uno et al. | 430/538 |

FOREIGN PATENT DOCUMENTS 53-31125 3/1978 Japan .

*Primary Examiner*—Hoa Van Le

*Attorney, Agent, or Firm*—Cushman, Darby & Cushman

[57] ABSTRACT

Disclosed is a support used for photographic materials which is prevented from staining of the edge portion which is caused by permeation of developing solution from cut section. This support for photographic materials comprises a base paper both sides of which are coated with a resin, said base paper containing a titanium oxide coated with at least one metal oxide selected from the oxides of Al, Si, Mn, Zn and Ti.

6 Claims, No Drawings

SUPPORT FOR PHOTOGRAPHIC MATERIALS

This is a continuation of application Ser. No. 07/333,893, filed on Apr. 6, 1989, which was abandoned upon the filing hereof.

BACKGROUND OF THE INVENTION

The present invention relates to a support for photographic materials which comprises a base paper containing titanium oxide covered with a specific metal oxide, said base paper being coated with a resin on both sides, and more particularly to a support for photographic materials prevented from staining of edge portion which is caused by permeation of a development processing solution (hereinafter referred to as "developing solution") from cut sections of edge portions of a support.

Hitherto, so-called baryta paper comprising a paper coated with a baryta layer mainly composed of barium sulfate on one side has been used as a support for photographic materials. Recently, a waterproofed support made by coating both sides of a base paper with a resin has been used for automatic and high-speed development. However, even such waterproofed support cannot prevent permeation of developing solution from the cut section of edge portion. The developing solution permeating from the cut section of edge portion cannot be removed by a short-time photographic treatment and turns brown with heat or time, resulting in stain of edge portion of photographs and damaging the value as photograph. In order to prevent the staining of edge portion, it has been attempted to impart high sizing property to the base paper.

A sizing agent of fatty acid type as disclosed in Japanese Patent Kokoku No. 47-26961 and alkyl ketene dimers as disclosed in Japanese Patent Kokai No. 51-132822 have been used as sizing agent for photographic base paper. However, these have respective defects and are still not satisfactory. That is, the fatty acid soap type sizing agent suffers from the problems that it is low in sizing effect against the alkali in developing solution and susceptible to the effect of hardness of water used in preparation of base paper. On the other hand, the alkyl ketene dimers have the problems that they are low in sizing effect against the alcohol in the developing solution and besides cannot provide sufficient sizing property unless a polyamide-polyamine epichlorohydrin resin known as a fixing agent is used in a relatively large amount. Thus, none of these sizing agents are fully satisfactory for base paper for photographic materials. Japanese Patent Kokai No. 58-80637 proposes a method for preventing staining of edge portion by impregnating a base paper with a specific polyvinyl alcohol and a divalent metal salt or coating them on the base paper. However, this method is also not satisfactory.

SUMMARY OF THE INVENTION

An object of the present invention is to provide a support for photographic materials which comprises a base paper coated with a resin on both sides and which is prevented from permeation of a developing solution into edge portion thereof and thus prevented from staining of cut sections of edge portions.

Thus, the present invention provides a support for photographic materials which comprises a base paper coated with a resin on both sides, said base paper containing titanium oxide coated with at least one metal oxide selected from oxides of Al, Si, Mn, Zn and Ti.

DESCRIPTION OF THE PREFERRED EMBODIMENTS

The effect of the present invention can be obtained by incorporating titanium oxide pigment coated with a specific metal oxide in a base paper containing a sizing agent. By incorporating the metal oxide coated titanium oxide into the base paper, a filling effect between pulp fibers at cut sections of edge portions of photographic paper is exhibited, which results in preventing permeation of a developing solution from the cut sections during the development. In contrast, when non-surface treated titanium oxide is used, since active sites on surfaces of the titanium oxide particles adsorb coloring components such as grounds, tar, and stains of oxides of dyestuffs present in the developing solution, coloring becomes remarkably. The surface treatment of titanium oxide with the special metal oxide seems to inactivate the active sites, resulting in preventing permeation and coloring due to the developing solution.

Titanium oxide coated with a specific metal oxide can be contained in a base paper preferably by directly adding the titanium oxide to pulp slurry or by previously dispersing the titanium oxide in water and adding this dispersion to pulp slurry. Alternatively, a dispersion of the titanium oxide may be impregnated into the base paper or coated on both sides of the base paper by size press method, tub sizing method, etc.

The titanium oxide used in the present invention may be prepared either by a sulfuric acid method or a chlorine method. Furthermore, the titanium oxide may be anatase or rutile type or a mixture thereof. The particle size thereof has no special limitation, but preferably is 0.1–1 $\mu$m.

Content of titanium oxide in base paper is preferably 5–20% by weight based on the base paper. If the content is too low, staining of edge portion of the support cannot be fully prevented and if it is too high, not only the paper strength is deteriorated, but also sizing property is reduced and staining of edge portion much increases.

Further, it is also possible to incorporate two or more different kinds of titanium oxide surface treated with the special metal oxides in combination into the base paper.

The metal oxides used for coating titanium oxide are preferably oxides of Al, Si, Mn, Zn and Ti. These may be used alone or in combination of two or more. The coating method is preferably a commonly employed wet process which comprises coating the metal oxide on titanium oxide in a titanium oxide slurry. For example, in the case of surface treatment with aluminum oxide, a water-soluble aluminum salt such as sodium aluminate is added to a water dispersion of titanium oxide, followed by neutralization with an acid such as sulfuric acid. The thus surface treated titanium oxide is filtered, washed with water, and ground for giving the desired pigments used in the present invention. A very surprising thing is that even if ordinary titanium oxide is surface treated with an oxide of titanium, the same effect as obtained in the case of using other metals for the surface treatment can be obtained. More concretely, ordinary titanium oxide particles obtained by synthesizing by a hydrochloric acid method or sulfuric acid method, calcining and grinding is added to water to give a slurry, and subjected to the surface treatment with an oxide of titanium, active sites on the titanium oxide particle surfaces are inactivated by adsorption of complex oxides of titanium to exhibit the effect of the metal oxide coated titanium oxide.

On the other hand, a dry process which comprises mixing or stirring titanium oxide and metal oxide gives uneven coat and does not exhibit sufficient effect and so is not preferred.

Coating amount of the metal oxide on the titanium oxide is preferably 1-10% by weight of the titanium oxide. When the coating amount is too small, prevention of staining of edge portion of the resulting support cannot be sufficiently attained and when too large, not only the preventive effect for staining of edge portion is not improved, but also titanium oxide particles per se bond to each other and cannot be uniformly dispersed in pulp slurry.

Sizing agents used for practice of the present invention includes, for example, fatty acid metal salts or/and dialkyl ketene dimers and/or dialkyl ketones, alkenyl or alkylsuccinic acid anhydrides, epoxidized higher fatty acid amides disclosed in Japanese Patent Kokai No. 54-147211 and organofluoro compounds disclosed in Japanese Patent Kokai No. 56-109343.

Sizing agents useful for effectively attaining the object of the present invention are dialkyl ketene dimers and/or dialkyl ketones. Content of the dialkyl ketene dimers and/or dialkyl ketones in base paper is preferably 0.1-2.0% by weight of pulp. As further preferred sizing agents, mention may be made of, for example, higher fatty acid metal salts which can be fixed to pulp with water-soluble aluminum salts such as aluminum chloride, aluminum sulfate and polyaluminum chloride. Content of the higher fatty acid salts in base paper is preferably 0.5-3% by weight of pulp.

Preferably the base paper used in the present invention further contains a cationic wet strength agent. The cationic wet strength agent useful in the present invention is preferably a polyamide-polyamine epichlorohydrin resin. The polyamide polyamine epichlorohydrin resins can be those which are commonly used in the field of paper-making.

Addition amount of the polyamide-polyamine epichlorohydrin resin to base paper is preferably 0.1-1.5% by weight of pulp.

The base paper may further contain various water-soluble polymer compounds. The water-soluble polymer compounds may be at least one of polyacrylamide, starch, starch derivatives, polyvinyl alcohol and gelatin. The polyacrylamides may be any of cationic, anionic and amphoteric ones. The starch may be any of those which are normally used in the field of paper-making and especially preferred are cationized starch and phosphoric acid esterified starch for internal addition and oxidized starch for tub sizing. The polyvinyl alcohol may be any of completely saponified, partially saponified, carboxyl-modified, cation-modified and other various modified polyvinyl alcohols. The gelatin may be any of alkali-treated gelatin, acid-treated gelatin and various modified gelatins. These polymer compounds can be contained in the base paper by adding them to a pulp slurry before making paper, or by tub sizing after making paper or by coating an aqueous solution thereof on the base paper by various coaters.

The base paper used in the present invention may further contain various water-soluble inorganic salts. The water-soluble inorganic salts are preferably inorganic salts containing sodium, calcium, lithium, magnesium or barium. Examples thereof are sodium chloride, sodium sulfate, sodium phosphate, calcium chloride, lithium chloride, magnesium chloride, magnesium sulfate and barium chloride.

Content of these water-soluble inorganic salts in the base paper is preferably 0.1-5.0 g/m$^2$. When it is less than 0.1 g/m$^2$, static charging of the base paper and the resulting support cannot be sufficiently prevented to cause various problems in operation. When more than 5.0 g/m$^2$, strength of the base paper decreases and this is not desired.

Method for containing these water-soluble inorganic salts in the base paper is not limitative and generally they are added to a tub-sizing solution.

The base paper used in the present invention may further contain various additives, for example, fixing agents such as aluminum sulfate and aluminum chloride, strength agents such as melamine resin, urea resin, and epoxidized polyamide resin, fillers such as calcium carbonate, kaolin, talc, and clay, organic conducting agents, fluorescent brightening agents, dyes, pigments and antioxidants.

The base paper which constitutes the support of the present invention may be any of those which are generally used for photography, such as pulp papers made from natural pulp, synthetic pulp or mixtures thereof. Among them, preferred are natural pulp papers mainly composed of wood pulps such as soft-wood pulp, hardwood pulp and mixtures of soft-wood pulp and hardwood pulp.

Thickness of the base paper used in the present invention is not critical and the papers are preferably those which are high in smoothness imparted, for example, by compression with application of pressure by a calender after making into paper and which have a basis weight of 40-250 g/m$^2$.

Resins used for coating a base paper in the present invention are preferably polyolefin resins and electron radiation curing resins. As the polyolefin resins, mention may be made of homopolymers such as low-density polyethylene, high-density polyethylene, polypropylene, polybutene, and polypentene, copolymers comprising two or more $\alpha$-olefins such as ethylene-propylene copolymer, linear low-density polyethylene which is a copolymer of ethylene and $\alpha$-olefin and mixtures thereof. These resins which have various densities and melt indices can be used alone or in combination of two or more. Preferably, low-density polyethylene, medium-density polyethylene, high-density polyethylene, or ethylene-propylene copolymer are used alone or in combination of two or more.

The electron radiation curing resins include resins which have C=C unsaturated bond such as acryloyl group or methacryloyl group in a molecular side chain or at a molecular terminal. As typical examples thereof, mention may be made of ester acrylates, ester methacrylates, epoxy acrylate, epoxy methacrylate, urethane acrylate, urethane methacrylate, monofunctional acrylates, monofunctional methacrylates, polyfunctional acrylates and polyfunctional methacrylates.

The resins for coating the base paper may contain various additives, for example, white pigments such as titanium oxide, zinc oxide, talc, and calcium carbonate, fatty acid amides such as stearic acid amide and arachidic acid amide, metal salts of fatty acids such as zinc stearate, calcium stearate, aluminum stearate, magnesium stearate, zinc palmitate, zinc myristate, and calcium palmitate, antioxidants such as hindered phenols, hindered amines, phosphorus-containing antioxidants and sulfur-containing antioxidants, blue pigments and dyes such as cobalt blue, ultramarine blue, cerulean blue and phthalocyanine blue, magenta pigments or dyes such as cobalt violet, fast violet and manganese violet, fluorescent brightening agents and ultraviolet absorbers. These may be used in optional combination.

The support for photographic materials of the present invention can be produced by so-called extrusion coating method which comprises casting a heated and molten resin on a traveling base paper. Both sides of the base paper is thus coated with the resin. In the case of electron radiation curing resin, the resin is coated on the paper by commonly used coaters such as gravure coater and blade coater and then irradiated with electron beams to cure the resin. It is preferred to subject the base paper to activation treatments such as corona discharge treatment and flame treatment prior to coating with the resin.

The emulsion layer side of the support for photographic materials has a glossy surface, a matte surface or a silky surface depending on use and the back side usually has unglossy surface. If necessary, the surface side and back side can be subjected to activation treatment such as corona discharge treatment. Thickness of the resin layer coated is not critical, but preferably is about 5-50 μm.

Various back coat layer can be provided on the back side of the support of the present invention for antistatic purpose, prevention of curling and imparting writability. The back coat layer may contain, in suitable combination, inorganic antistatic agent, organic anti-static agent, hydrophilic binder, latex, hardener, pigment and surface active agent.

The support of the present invention on which various photographic layers are provided can be used for various purposes such as color photographic paper, monochromatic photographic paper, photographic paper for typesetting, photographic paper for copying, reversal photographic material, negative and positive for silver complex diffusion transfer process and printing material.

The present invention is explained in detail by the following examples where parts and % are by weight unless otherwise notified.

EXAMPLE 1

A mixed stuff composed of 50 parts of hard-wood bleached kraft pulp and 50 parts of soft-wood bleached kraft pulp was beaten to a Canadian standard freeness of 310 ml and titanium oxide (rutile type), calcium carbonate or clay shown in Table 1 was internally added according to the following formulations to make a paper having a basis weight of 170 g/m². (Numerical values in the formulations indicate "part".) Formulation for internal addition of alkyl ketene dimer sizing agent:

| | |
|---|---|
| Pulp (LBKP/NBKP) | 100 |
| Fluorescent brightening agent | 0.15 |
| Blue dye | 0.00005 |
| Alkyl ketene dimer emulsion (AKDE) | 0.4 |
| Polyamide-polyamine epichlorohydrin resin | 0.4 |
| Titanium oxide, calcium carbonate or clay | As shown in Table 1 |

Formulations for internal addition of higher fatty acid metal salt

| | |
|---|---|
| Pulp (LBKP/NBKP) | 100 |
| Fluorescent brightening agent | 0.15 |
| Blue dye | 0.00005 |
| Higher fatty acid metal salt | 1.0 |
| Aluminum sulfate | 1.0 |
| Polyamide polyamine epichlorohydrin | 0.4 |
| Titanium oxide, calcium carbonate or clay | As shown in Table 1 |

TABLE 1

| Sample No. | Amount of surface treatment *1 Al | Si | Mn | Zn | Ti | Content of titanium oxide *2 | Note |
|---|---|---|---|---|---|---|---|
| 1 | — | — | — | — | — | — | Comparison |
| 2 | — | — | — | — | — | 5 | |
| 3 | — | — | — | — | — | 20 | |
| 4 | 0.4 | 0.2 | — | — | — | 10 | The present invention |
| 5 | 0.4 | 0.4 | — | — | — | 10 | |
| 6 | 0.5 | 0.5 | — | — | — | 10 | |
| 7 | 1.0 | 1.0 | — | — | — | 10 | |
| 8 | 2.5 | 2.5 | — | — | — | 3 | |
| 9 | 2.5 | 2.5 | — | — | — | 5 | |
| 10 | 2.5 | 2.5 | — | — | — | 10 | |
| 11 | 2.5 | 2.5 | — | — | — | 20 | |
| 12 | 2.5 | 2.5 | — | — | — | 25 | |
| 13 | 2.0 | 2.0 | 1.0 | — | — | 10 | |
| 14 | 2.0 | 2.0 | — | 1.0 | — | 10 | |
| 15 | 2.0 | 2.0 | — | — | 1.0 | 10 | |
| 16 | 1.0 | 1.0 | 1.0 | 1.0 | 1.0 | 10 | |
| 17 | 5.0 | 5.0 | — | — | — | 10 | |
| 18 | 6.0 | 6.0 | — | — | — | 10 | |
| 19 | 5.0 | — | — | — | — | 10 | |
| 20 | — | 5.0 | — | — | — | 10 | |
| 21 | — | — | 5.0 | — | — | 10 | |
| 22 | — | — | — | 5.0 | — | 10 | |
| 23 | — | — | — | — | 5.0 | 10 | |
| 24 | Calcium carbonate | | | | | 10 | Comparison |
| 25 | Clay | | | | | 10 | |

Note
*1: % based on the weight of titanium oxide
*2: % based on the weight of base paper The resulting wet paper was subjected to wet pressing and then dried by a drum drier of 110° C. This paper was impregnated with 20 g/m² of a tub-sizing solution of the following formulation and dried by a hot-air constant temperature drier of 110° C. (Numerical values in the formulation indicate part.).

| | |
|---|---|
| Carboxy modified polyvinyl alcohol | 4.0 |
| Fluorescent brightening agent | 0.03 |
| Blue dye | 0.001 |
| Sodium chloride | 3.0 |
| Water added to make up the total amount 100 | |

The impregnated and dried paper was subjected to machine calender treatment at a linear pressure of 90 kg/cm an then both sides of the paper were subjected to corona discharge treatment. On the back side of this base paper was coated a mixture (1:1) of a high-density polyethylene (density: 0.96 g/cm³, MI=5) and a low-density polyethylene (density: 0.92 g/cm³, MI=5) at a thickness of 30 μm at a resin temperature of 330° C. by a melt extrusion coater. Then, on the surface side of the paper was coated a mixture (7:3) of a low-density polyethylene (polyethylene density before addition of pigment: 0.92 g/cm³, MI=5) and a high-density polyethylene (polyethylene density before addition of pigment: 0.96 g/cm³, MI=5) which contained 10% of anatase type titanium oxide at a thickness of 30 μm at a resin temperature of 330° C.

Then, the surface of the polyethylene containing the titanium oxide was subjected to corona discharge treatment. Thereafter, on the thus treated surface were coated in succession a blue-sensitive gelatino silver halide emulsion layer containing a yellow coupler, an interlayer, a green-sensitive gelatino silver halide emulsion layer containing a magenta coupler, an ultraviolet absorbing layer containing an ultraviolet absorber, and a red-sensitive gelatino silver halide emulsion layer containing a cyan coupler and a protective layer therefor by an extrusion method and this laminate was dried to obtain a multi-layer silver halide color photographic paper.

The resulting samples were stored in a thermo-hydrostat of 50° C., 60% RH for one day and then evaluated on staining of edge by the following methods.

(Evaluation on permeation of developing solution)

The samples were subjected to the following development and length of permeation of the developing solution from the cut section was measured by using a magnifier and the results are shown in Table 2.

| [Development process (33° C.)] | |
|---|---|
| Coupling development | 3 minutes and 30 seconds |
| Bleaching fixation | 1 minute and 30 seconds |
| Washing with water | 3 minutes |
| Drying | 60 seconds (60–80° C.) |

Development was carried out by a continuous automatic developing machine (Color sheet roll processor manufactured by FC Seisakusho Co.).

(Evaluation on coloration of edge portion)

The thus developed samples were subjected to thermo-treatment at 50° C. for 7 days and the degree of coloration of the cut section was visually evaluated according to the following criteria and the results are shown in Table 2.

A: Substantially no coloration was seen.

B: Slight coloration was seen.

C: Clear coloration was seen.

D: Conspicuous coloration was seen.

Only samples judged to be A or B in the above criteria are practically acceptable.

TABLE 2

| | Addition of AKDE | | Addition of higher fatty acid metal salt | | |
|---|---|---|---|---|---|
| Sample No. | Length of permeation of developing solution (mm) | Coloration of edge | Length of permeation of developing solution (mm) | Coloration of edge | Note |
| 1 | 0.3 | D | 0.4 | D | Comparison |
| 2 | 0.3 | C | 0.4 | C | Comparison |
| 3 | 0.5 | C | 0.6 | C | Comparison |
| 4 | 0.3 | B | 0.4 | B | The present invention |
| 5 | 0.3 | B | 0.4 | B | |
| 6 | 0.2 | B | 0.3 | A | |
| 7 | 0.2 | A | 0.3 | A | |
| 8 | 0.3 | B | 0.4 | B | |
| 9 | 0.3 | B | 0.4 | B | |
| 10 | 0.15 | B | 0.2 | A | |
| 11 | 0.2 | A | 0.3 | A | |
| 12 | 0.3 | B | 0.4 | B | |
| 13 | 0.15 | A | 0.2 | A | |
| 14 | 0.15 | A | 0.2 | A | |
| 15 | 0.15 | A | 0.2 | A | |
| 16 | 0.15 | A | 0.2 | A | |
| 17 | 0.2 | A | 0.3 | A | |

TABLE 2-continued

| | Addition of AKDE | | Addition of higher fatty acid metal salt | | |
|---|---|---|---|---|---|
| Sample No. | Length of permeation of developing solution (mm) | Coloration of edge | Length of permeation of developing solution (mm) | Coloration of edge | Note |
| 18 | 0.3 | B | 0.4 | B | |
| 19 | 0.15 | B | 0.2 | A | |
| 20 | 0.25 | B | 0.3 | B | |
| 21 | 0.20 | B | 0.3 | B | |
| 22 | 0.20 | B | 0.3 | B | |
| 23 | 0.25 | B | 0.3 | B | |
| 24 | 0.4 | D | 0.5 | D | Comparison |
| 25 | 0.35 | D | 0.6 | D | |

EXAMPLE 2

Example 1 was repeated except that anatase type titanium oxide was used in place of the rutile type titanium oxide. The results obtained are shown in Table 3.

TABLE 3

| | Addition of AKDE | | Addition of higher fatty acid metal salt | | |
|---|---|---|---|---|---|
| Sample No. | Length of permeation of developing solution (mm) | Coloration of edge | Length of permeation of developing solution (mm) | Coloration of edge | Note |
| 1 | 0.2 | D | 0.3 | D | Comparison |
| 2 | 0.5 | D | 0.7 | D | Comparison |
| 3 | 0.5 | C | 0.6 | C | Comparison |
| 4 | 0.3 | B | 0.4 | B | The present invention |
| 5 | 0.3 | B | 0.4 | B | |
| 6 | 0.2 | B | 0.3 | B | |
| 7 | 0.2 | A | 0.3 | A | |
| 8 | 0.3 | B | 0.4 | B | |
| 9 | 0.3 | B | 0.4 | B | |
| 10 | 0.15 | B | 0.2 | A | |
| 11 | 0.2 | A | 0.3 | A | |
| 12 | 0.3 | B | 0.4 | B | |
| 13 | 0.15 | A | 0.2 | A | |
| 14 | 0.15 | A | 0.2 | A | |
| 15 | 0.15 | A | 0.2 | A | |
| 16 | 0.2 | A | 0.3 | A | |
| 17 | 0.2 | A | 0.3 | A | |
| 18 | 0.3 | B | 0.4 | B | |

As is clear from Tables 2 and 3, only the supports for photographic materials prepared using the titanium oxide according to the present invention were less in staining of edge portion after development, namely, less in permeation of developing solution and coloration of edge portion.

What is claimed is:

1. A support for photographic materials, which comprises a base paper coated with a resin on both sides, said base paper containing titanium oxide coated with at least one metal oxide selected from the group consisting of oxides of Al, Si, Mn, Zn and Ti, wherein coating amount of the metal oxide is 1–10% by weight of the titanium oxide, and wherein content of the titanium oxide is 5–20% by weight of the base paper.

2. A support according to claim 1, wherein the coating of titanium oxide with at least one metal oxide is carried out by a wet process.

3. A support according to claim 1, wherein the coating of titanium oxide with at least one metal oxide is carried out in a slurry of at least one metal oxide.

4. A support according to claim 1, wherein the base paper has been made from a pulp slurry containing metal oxide coated titanium oxide.

5. A support according to claim 1, wherein the content of the titanium oxide is 5 to 10% by weight based on the weight of the base paper.

6. A support according to claim 1, wherein the content of the titanium oxide is 10 to 20% by weight based on the weight of the base paper.

* * * * *